US011292010B2

(12) United States Patent
Farquhar et al.

(10) Patent No.: US 11,292,010 B2
(45) Date of Patent: Apr. 5, 2022

(54) MAGNETIC DRUM SEPARATOR WITH CAM ACTIVATED MAGNETS

(71) Applicant: Halliburton Energy Services, Inc., Houston, TX (US)

(72) Inventors: Michael J. Farquhar, Aberdeenshire (GB); Derek Mackay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 127 days.

(21) Appl. No.: 16/593,925

(22) Filed: Oct. 4, 2019

(65) Prior Publication Data

US 2020/0215549 A1 Jul. 9, 2020

Related U.S. Application Data

(60) Provisional application No. 62/789,906, filed on Jan. 8, 2019.

(51) Int. Cl.
*B03C 1/033* (2006.01)
*B03C 1/12* (2006.01)

(52) U.S. Cl.
CPC ..... *B03C 1/12* (2013.01); *B03C 2201/20* (2013.01)

(58) Field of Classification Search
CPC ..... B03C 1/12; B03C 2201/20; B03C 1/03; B03C 1/10; B03C 1/247
(Continued)

(56) References Cited

U.S. PATENT DOCUMENTS 8,807,344 B2 * 8/2014 Keaton ..... B03C 1/14 209/223.2
2008/0164184 A1 7/2008 Marston et al.
(Continued)

FOREIGN PATENT DOCUMENTS

CA 2588170 A1 11/2007
JP 2006021147 A * 1/2006
WO 2018/172843 A1 9/2018

OTHER PUBLICATIONS

Sousan, Fumio, "Method and Apparatus for Magnetic Sorting" (English Translatio), Jan. 26, 2006, worldwide.espacenet.com (Year: 2006).*

(Continued)

*Primary Examiner* — Michael McCullough
*Assistant Examiner* — Molly K Devine
(74) *Attorney, Agent, or Firm* — Tenley Krueger; Baker Botts L.L.P.

(57) ABSTRACT

A magnetic drum separator is provided. The drum separator includes a drum and a pulley arrangement that rotates the drum. The drum separator includes an end plate coupled to the drive assembly, and the drive assembly rotates the end plate with the drum. The end plate includes a radially oriented slot. A plurality of magnets is disposed in the drum, and the magnets are attached to the end plates and rotatable with the drum. A cam assembly is disposed in the drum and remains stationary during rotation of the drum. The cam assembly includes a cam with a cam track formed therein. The magnets have a cam follower located in the cam track and an end plate follower located in the slot of the end plate. The cam track and the radially oriented slot guide the plurality of magnets to move radially inwards and outwards as the magnets rotate.

18 Claims, 11 Drawing Sheets

(58) Field of Classification Search
USPC ..... 209/219
See application file for complete search history.

(56) References Cited

U.S. PATENT DOCUMENTS

| | | | |
|---|---|---|---|
| 2008/0210613 | A1 | 9/2008 | Wechsler et al. |
| 2008/0264691 | A1 | 10/2008 | Allen |
| 2013/0240413 | A1 | 9/2013 | Keaton et al. |

OTHER PUBLICATIONS

International Search Report and Written Opinion issued in related PCT Application No. PCT/US2019/055123 dated Jan. 23, 2020, 8 pages.
Examination Report issued in related GCC Application No. 2019-38772 dated Jun. 28, 2021, 4 pages.
International Preliminary Report on Patentability issued in related PCT Application No. PCT/US2019/055123 dated Jul. 22, 2021, 5 pages.

* cited by examiner

MAGNETIC DRUM SEPARATOR WITH CAM ACTIVATED MAGNETS

CROSS REFERENCE TO RELATED APPLICATION

This application claims priority from the U.S. Provisional Application Ser. No. 62/789,906; filed Jan. 8, 2019, entitled "MAGNETIC DRUM SEPARATOR WITH CAM ACTIVATED MAGNETS", the disclosure of which is incorporated herein by reference.

TECHNICAL FIELD

The present disclosure relates generally to magnetic separators and, more particularly, to a magnetic drum separator with a cam assembly providing controlled movement of the magnets.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation. After drilling a wellbore that intersects a subterranean hydrocarbon-bearing formation, a variety of wellbore tools may be positioned in the wellbore during completion, production, or remedial activities. It is common practice in completing oil and gas wells to set a string of pipe, known as casing, in the well and use a cement sheath around the outside of the casing to isolate the various formations penetrated by the well.

At times, slot recovery and/or decommissioning operations may be performed on an oil and gas well. These operations often require the removal of sections of the original casing, e.g., via extensive milling operations. Such milling operations generate significant quantities of swarf (metallic shavings, filing, and particulates). Section and window milling operations used to sidetrack wells also generate large quantities of swarf. Removal of swarf from a milling fluid requires a reliable and efficient means of separation at the surface to ensure successful operations. If the harsh metallic materials are not removed, this can lead to excessive wear and tear on rig surface equipment and contamination of drilling fluids. Improvements in separation and recovery units used to separate swarf from a flow of fluid are desired.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
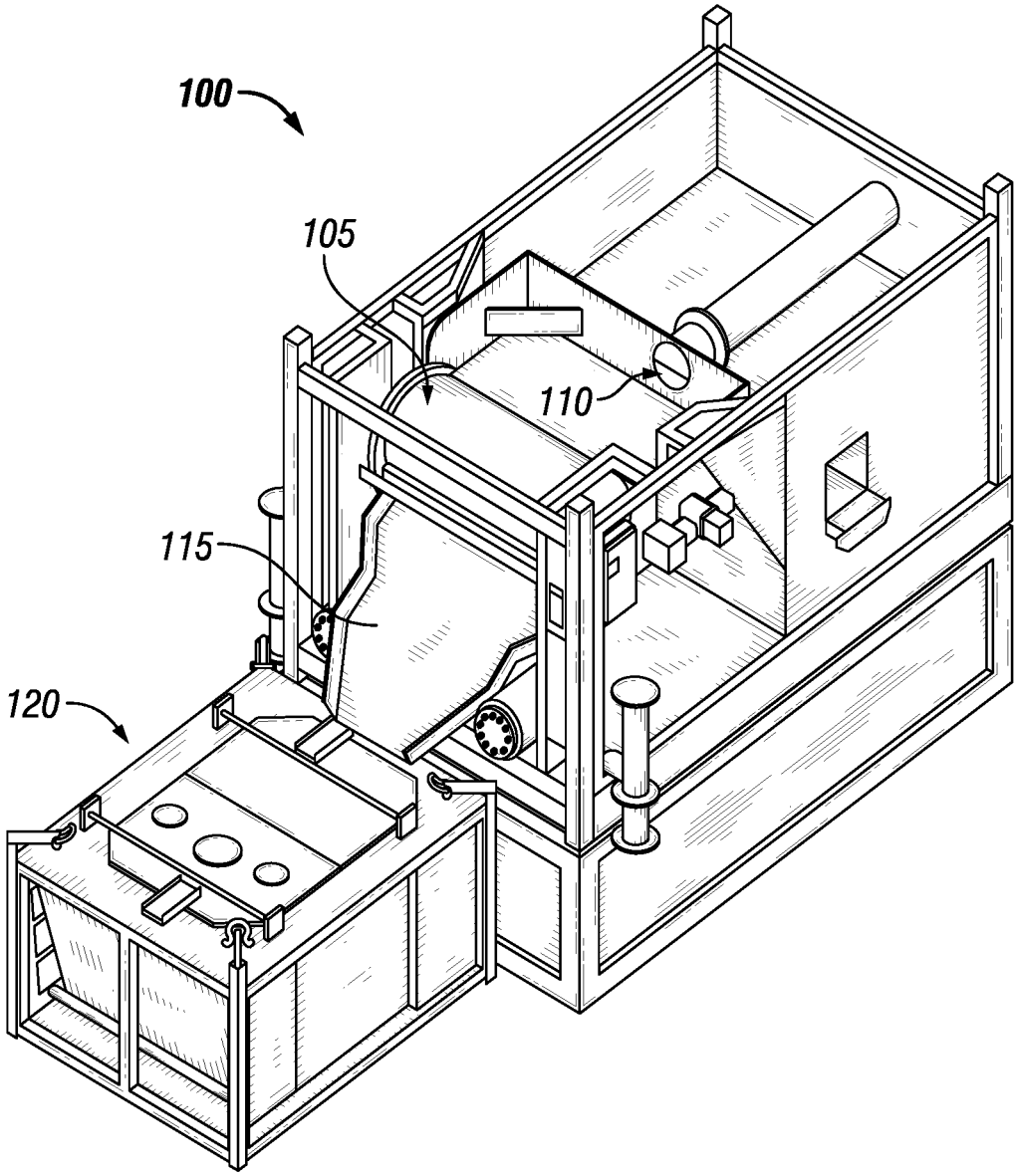
FIG. 1 is an isometric view of a swarf removal unit, in accordance with an embodiment of the present disclosure

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business-related constraints, which will vary from one implementation to another. Moreover, it will be appreciated that such a development effort might be complex and time consuming but would nevertheless be a routine undertaking for those of ordinary skill in the art having the benefit of the present disclosure. Furthermore, in no way should the following examples be read to limit, or define, the scope of the disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection or monitoring wells as well as production wells, including hydrocarbon wells. Embodiments may be implemented using a tool that is made suitable for separating swarf from an incoming fluid flow at a surface location proximate a well.

The terms "couple" or "couples" as used herein are intended to mean either an indirect or a direct connection. Thus, if a first device couples to a second device, that connection may be through a direct connection, or through an indirect mechanical, electromagnetic, or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections. Finally, the term "fluidically coupled" as used herein is intended to mean that there is either a direct or an indirect fluid flow path between two components.

The present disclosure is directed to a magnetic drum separator used to remove swarf from a flow of fluid without the magnets making contact with the fluid or swarf. The magnetic drum separator allows the magnets to be fully enclosed within a drum housing. The magnets are able to be selectively located close to the drum housing on a side where the drum separator is in contact with the fluid flow and moved radially away from the drum housing on a discharge side away from the fluid flow. When the magnets are located close to the drum housing, the magnets exert a magnetic force that attracts swarf within the fluid flow to the magnetic drum separator. Then, when the magnets are moved radially away from the drum housing, the magnetic force from the magnets decreases, thereby releasing the collected swarf from the outside of the drum.

The disclosed magnetic drum separator is designed to separate swarf from a drilling fluid. Return flow from a well passes through the unit, with the magnetic drum separator capturing a majority of the swarf and discarding the captured material into a collection area. The swarf may then be transported to a remote facility where the metal is recovered for recycling. Additional separation and/or polishing stages may be performed on the remaining fluid to remove any fine to ultra-fine magnetic particles that may still be entrained in the fluid.

In the disclosed embodiments, an array of magnets is located within a drum housing to form a wet magnetic drum separator. The magnets rotate with the drum housing but move away from the drum housing to allow the recovered swarf to be released from an outside of the drum housing. Existing separator units rely on gravity to move the magnets in this manner. The disclosed drum separator, however, is mechanically controlled via a cam assembly. This provides an increased control of the movement of magnets to selectively attract swarf to the drum separator and release the swarf into a discharge area. The magnets are moved in a controlled manner via the cam assembly to allow reliable and precise positioning of the magnets for collection/attraction of swarf and later discharge of the swarf. The magnetic drum separator is simple and effective and can be utilized for swarf recovery in fluid paths in various locations or as a stand-alone device. The disclosed cam assembly may be altered to suit requirements for a desired fluid flow/discharge arrangement, thereby allowing complete control of the magnetic field exerted by the drum separator.

Turning now to the drawings, FIG. 1 illustrates a swarf removal unit 100. In one or more embodiments, the swarf removal unit 100 may be configured to remove swarf (for example, metallic shavings, filing, particulates, and combinations thereof) from one or more fluids used in milling a well. The swarf removal unit 100 may be disposed at a surface location about a well, wherein the swarf removal unit 100 may be fluidly coupled to the well to receive one or more fluids as an input. In one or more embodiments, the one or more fluids may include ferrous swarf as a result of milling out a well. As illustrated, the swarf removal unit 100 may include a magnetic drum separator 105. The magnetic drum separator 105 may be configured to physically remove the ferrous swarf from the one or more fluids used in a milling operation, or other related operation. In one or more embodiments, an inlet 110 to the swarf removal unit 100 may provide a flowpath for the one or more fluids towards the magnetic drum separator 105. During operations, one or more fluids may flow from the inlet 110 to the magnetic drum separator 105. As the one or more fluids encounter the magnetic drum separator 105, the magnetic drum separator 105 may attract the ferrous swarf through a magnetic force provided by the internal components of the magnetic drum separator 105. As the one or more fluids encounter the magnetic drum separator 105, the magnetic drum separator 105 may remove and displace the ferrous swarf from the one or more fluids. The one or more fluids may subsequently flow below the magnetic drum separator 105 to be further processed. As the magnetic drum separator 105 operates, there may be a scraper ramp 115 disposed adjacent to and abutting the magnetic drum separator 105. The scraper ramp 115 may be any suitable size, height, shape, and combinations thereof. Further, the scraper ramp 115 may be included of any suitable material. The scraper ramp 115 may be disposed to abut the magnetic drum separator 105 at any suitable angle. The scraper ramp 115 may be configured to provide a physical barrier to any potential ferrous swarf disposed about the magnetic drum separator 105. During operations, the scraper ramp 115 may physically force the ferrous swarf to be removed from the magnetic drum separator 105. The ferrous swarf may subsequently slide down the scraper ramp 115 into a separate containment unit 120, wherein the scraper ramp 115 is coupled to the separate containment unit 120. In other embodiments, the scraper ramp 115 may not be coupled to the separate containment unit 120. The separate containment unit 120 may be any suitable size, height, shape, and combinations thereof. In one or more embodiments, the separate containment unit 120 may be configured to receive, store, transport, and combinations thereof the ferrous swarf removed from the one or more fluids.

Figure 2:
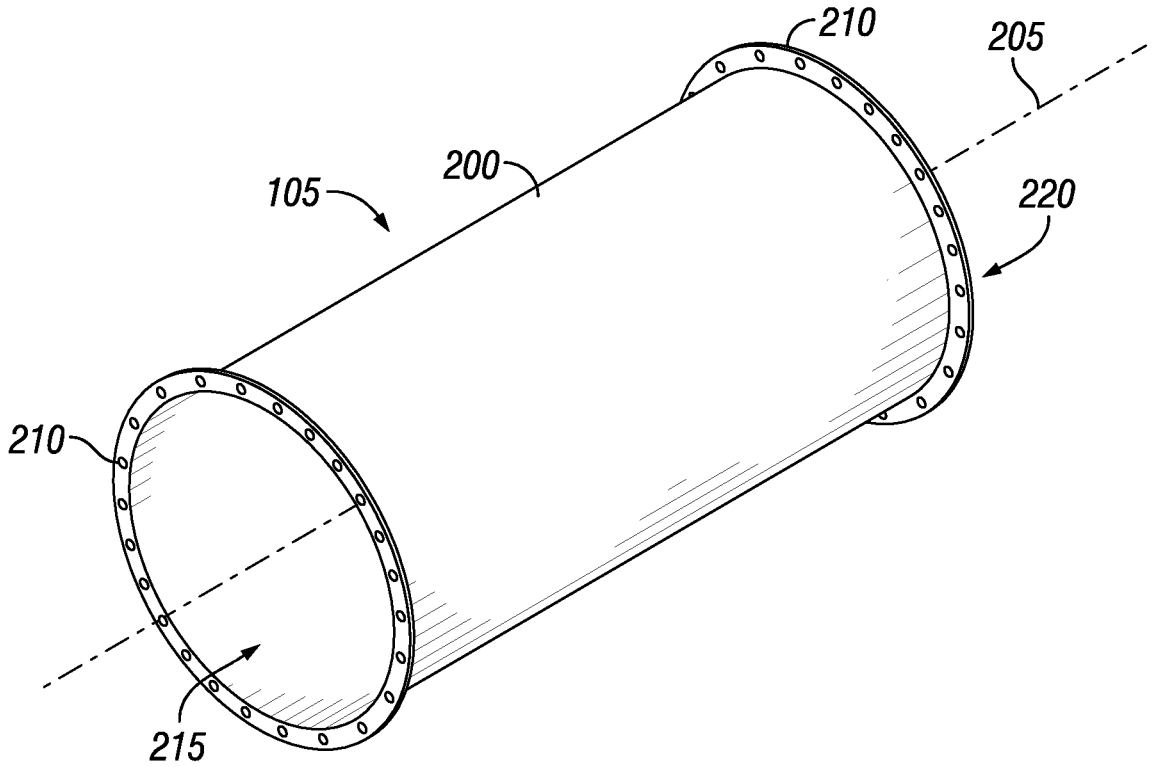
FIG. 2 is an isometric view of a drum of a magnetic drum separator, in accordance with an embodiment of the present disclosure.

FIG. 2 illustrates an embodiment of the magnetic drum separator 105. As illustrated, the magnetic drum separator 105 may include an outer drum (or drum housing) 200 that encloses an array of magnets and cam assembly (discussed further below). During operation of the swarf removal unit 100 (referring to FIG. 1) the drum 200 may be actuated to rotate around a central axis 205. In one or more embodiments, the array of magnets may rotate with rotation (and at the same rate of rotation) of the drum 200. The cam assembly, which may remain stationary as the drum 200 rotates, may displace a plurality of magnets in the array of magnets to move in a radially inward or outward direction (with respect to the central axis 205) at specific rotational positions about the central axis 205. The drum 200 may include a drum skin, wherein the drum skin is a thin-walled cylindrical component. In one or more embodiments, the drum skin may be non-magnetic. In other embodiments, the drum skin may be magnetic. The drum 200 may further include two drum flanges 210 to facilitate connection of the drum skin to other components of the magnetic drum separator 105. In one or more embodiments, one of the two drum flanges 210 may be disposed at a first end 215 of the drum 200 while the remaining one of the two drum flanges 210 may be disposed at a second end 220 of the drum 200, wherein the first end 215 and the second end 220 are opposite of each other.

Figure 3:
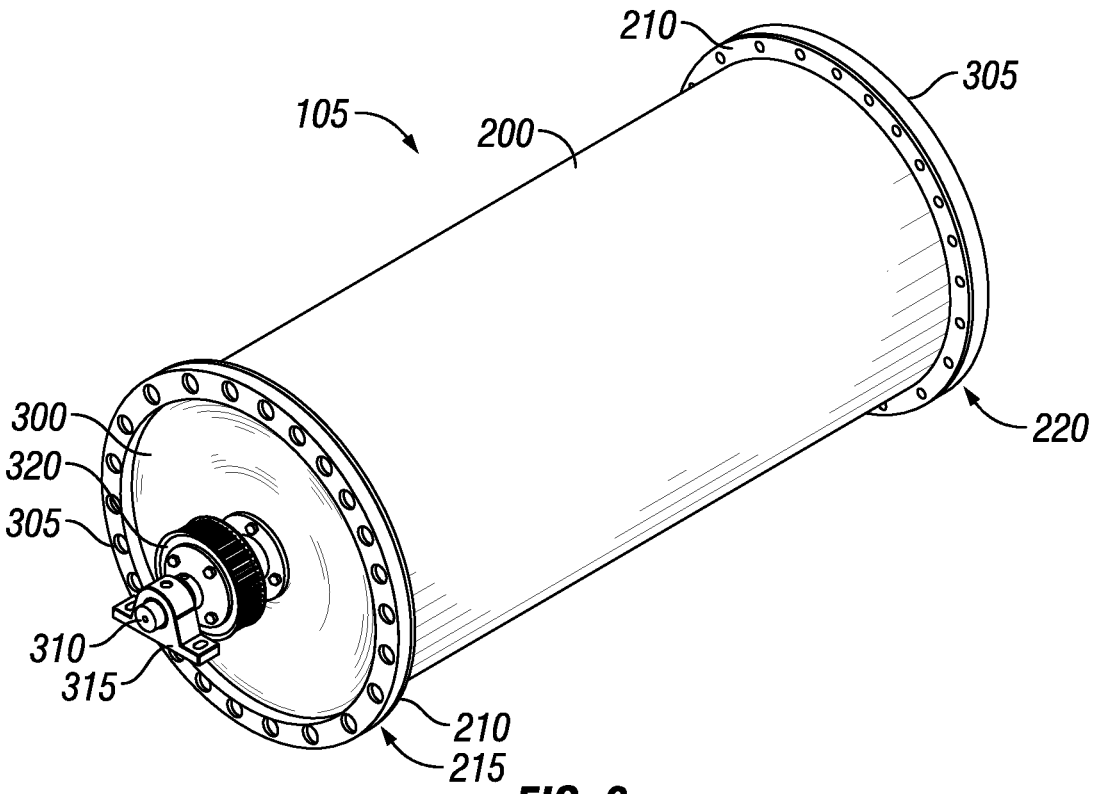
FIG. 3 is an isometric view of a magnetic drum separator, in accordance with an embodiment of the present disclosure.

FIG. 3 illustrates another embodiment of the magnetic drum separator 105. As illustrated in FIG. 3, the magnetic drum separator 105 may be fluidly sealed by a pair of drum end plates 300 disposed at the first end 215 and at the second end 220 of the drum 200. In one or more embodiments, a wear ring 305 may be disposed adjacent to and concentric with the drum end plates 300. The wear ring 305 may be disposed at the first end 215 and/or at the second end 220 of the drum 200. The wear ring 305 may provide a buffer between the magnetic drum separator 105 and the swarf removal unit 100 (referring to FIG. 1). During operations, as the magnetic drum separator 105 rotates, the wear ring 305 may absorb potential damage caused by the magnetic drum separator 105 interfacing with the swarf removal unit 100. Without limitations, the wear ring 305 may be included of nylon. In one or more embodiments, there may be a plurality of holes disposed through the drum flanges 210, the pair of drum end plates 300, the wear rings 305, and combinations thereof. In embodiments, the plurality of holes may be arranged uniformly in a circular pattern about an equivalent radial position. During assembly, the plurality of holes may be aligned and may be secured using any suitable fasteners to couple the wear rings 305 to the pair of drum end plates 300 to the drum flanges 210, wherein the pair of drum end plates 300 are disposed between the wear rings 305 and the drum flanges 210.

As illustrated, a drum shaft 310 may be disposed through the magnetic drum separator 105 along the central axis 205 (referring to FIG. 2). The drum shaft 310 may be any suitable size, height, shape, and combinations thereof. In embodiments, the drum shaft 310 may be a solid, elongated cylinder including a length longer than the length of the drum 200. The drum shaft 310 may be operable to support the components of the magnetic drum separator 105. In one or more embodiments, the drum shaft 310 may remain stationary as the drum 200 rotates about the central axis 205. The magnetic drum separator 105 may further include at least one shaft support 315 disposed at an end of the drum shaft 310 and a pulley arrangement 320 disposed between the at least one shaft support 315 and one of the drum end plates 300.

Figure 4:
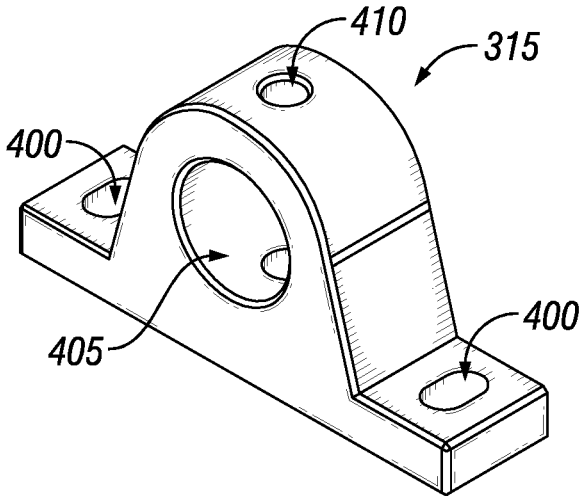
FIG. 4 is an isometric view of a shaft support, in accordance with an embodiment of the present disclosure.

Referring now to FIG. 4, the at least one shaft support 315 may be bolted down to an external surface through mounting holes 400 disposed through the at least one shaft support 315. In one or more embodiments, the mounting holes 400 may be disposed about opposite ends of the at least one shaft support 315. The at least one shaft support 315 may include a central bore 405, wherein the central bore 405 is configured to receive the drum shaft 310 (referring to FIG. 3). There may be a central hole 410 disposed in the at least one shaft support 315. The central hole 410 may be disposed vertically through the at least one shaft support 315 and perpendicular to the central bore 405. In one or more embodiments, the drum shaft 310 may include a hole disposed at an end of the drum shaft 310. During assembly, as the drum shaft 310 is disposed through the at least one shaft support 315, the hole in the drum shaft 310 may be aligned with the central hole 410 and a suitable fastener may be used to fasten the drum shaft 310 to the at least one shaft support 315.

Figure 5:
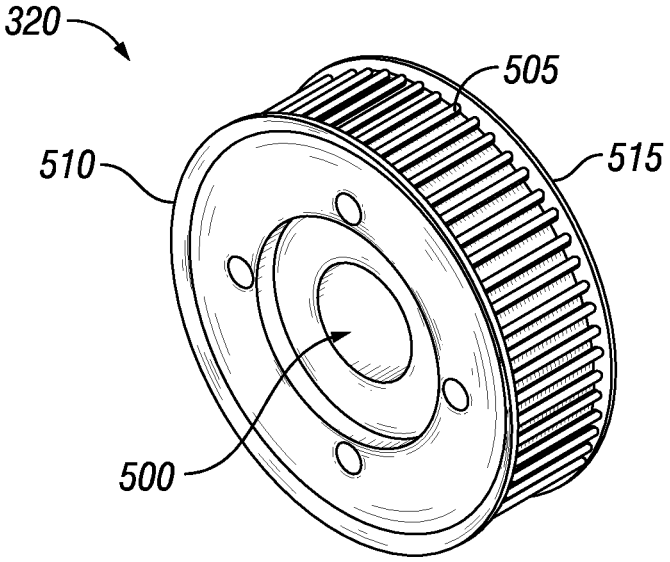
FIG. 5 is an isometric view of a pulley arrangement, in accordance with an embodiment of the present disclosure.
Figure 6A:
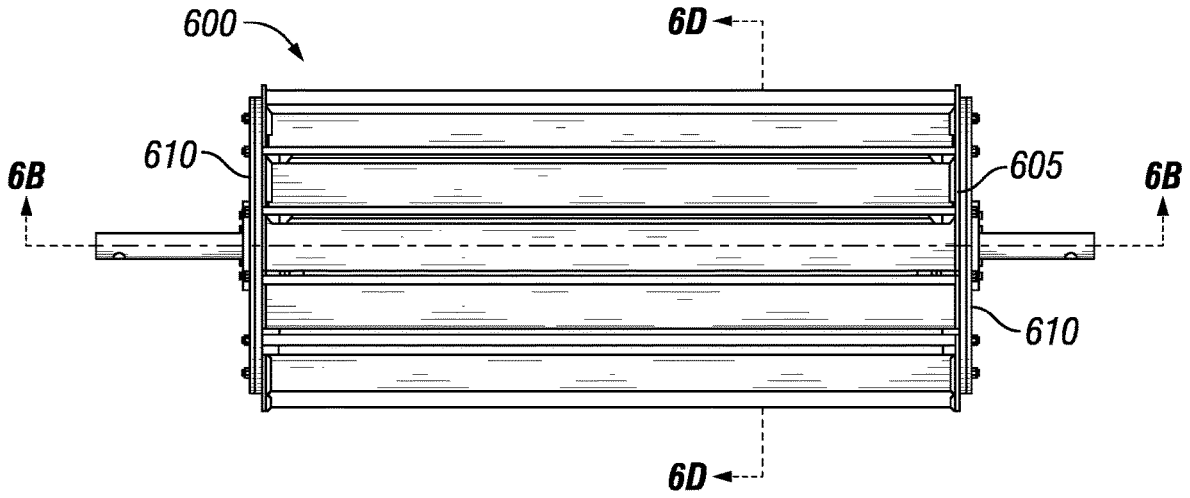
FIGS. 6A-6E are side, cross-sectional views, cutaway, and front views of a fully assembled cartridge used in the magnetic drum separator of FIG. 3, in accordance with an embodiment of the present disclosure.
Figure 6B:
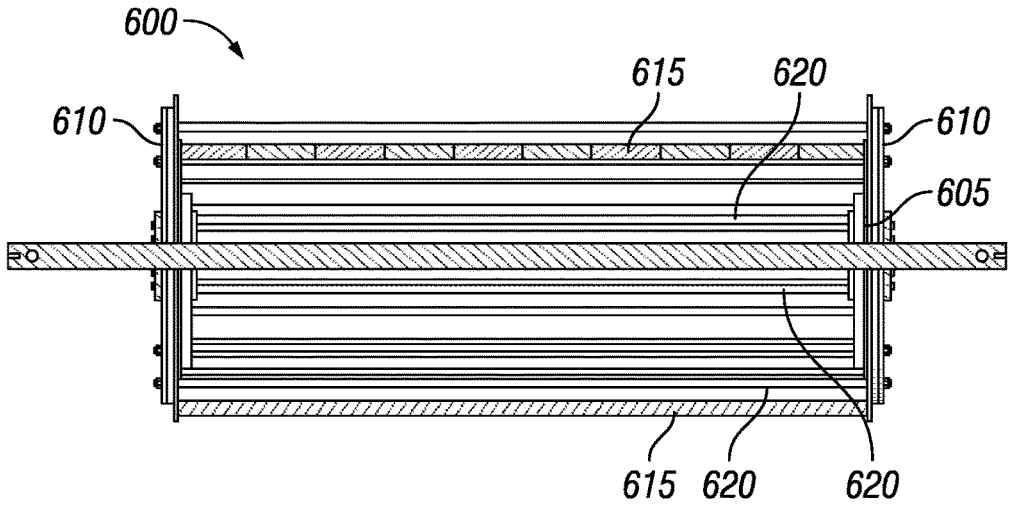
Figure 6C:
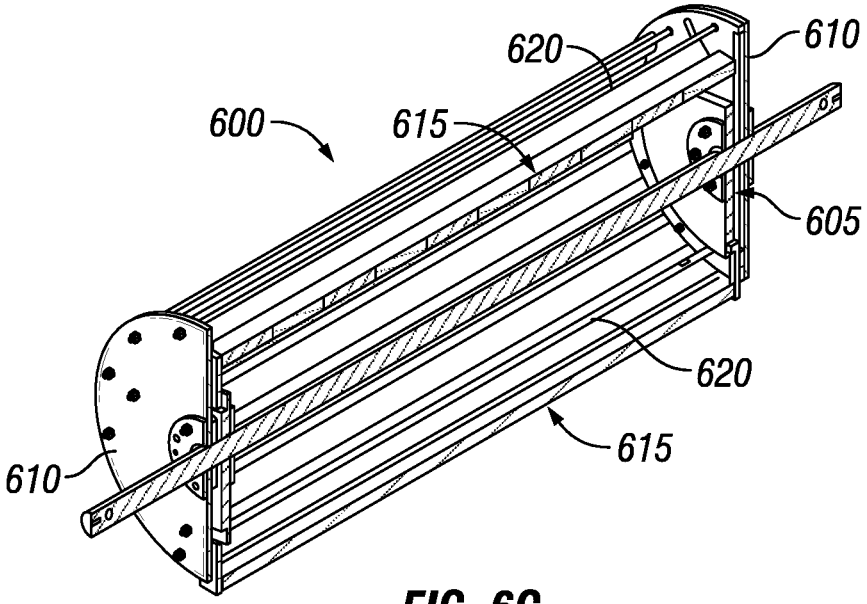
Figure 6D:
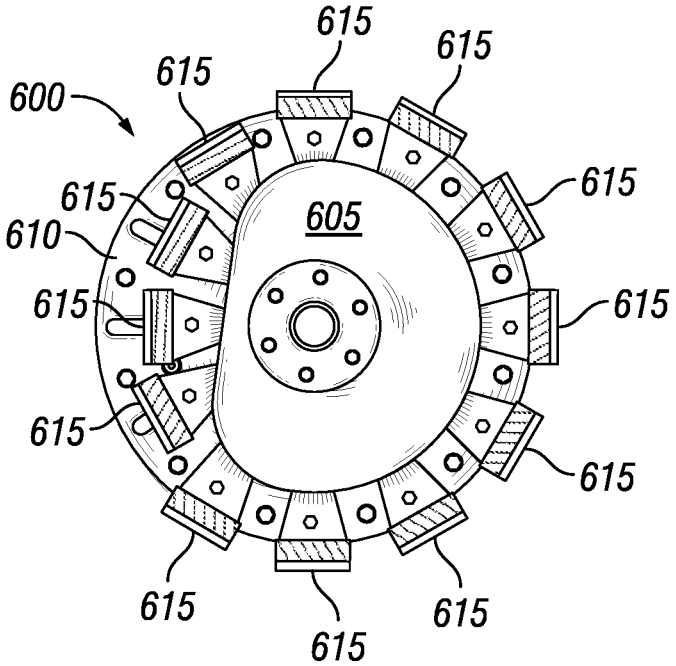
Figure 6E:
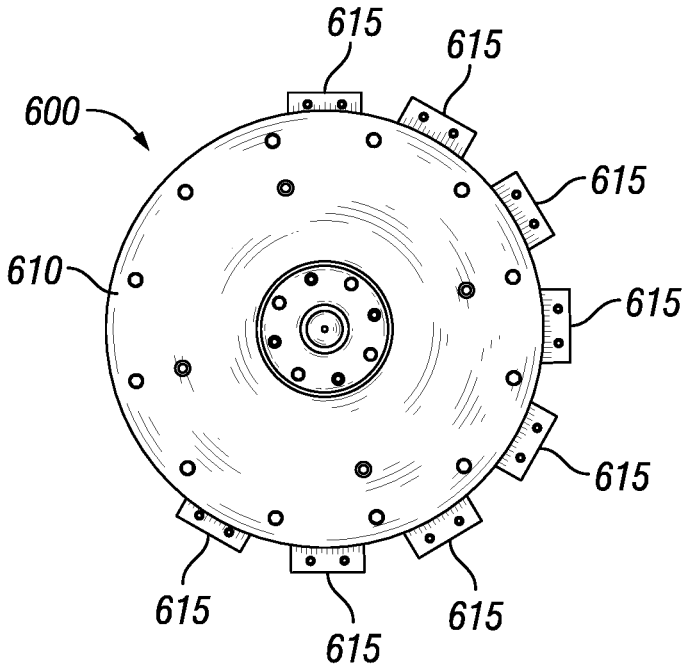

FIG. 5 illustrates an embodiment of the pulley arrangement 320. The pulley arrangement 320 may be any suitable size, height, shape, and combinations thereof. In one or more embodiments, the pulley arrangement 320 may have a circular cross-section. There may be a central bore 500 in the pulley arrangement 320, wherein the central bore 500 is configured to receive the drum shaft 310 (referring to FIG. 3). As illustrated, there may be a plurality of teeth 505 disposed along the circumference of the pulley arrangement 320. Each of the plurality of teeth 505 may have the same dimensions. As shown, the plurality of teeth 505 may be disposed between a first ridge 510 and a second ridge 515, wherein the distance between the first ridge 510 and the second ridge 515 defines the thickness of the pulley arrangement 320. During assembly, the pulley arrangement 320 may be coupled to a cable or belt (not shown) to operate as a pulley after the drum shaft 310 is disposed through the central bore 500 of the pulley arrangement 320. In one or more embodiments, the cable or belt may be disposed over a portion of the plurality of teeth 505 and between the first ridge 510 and the second ridge 515. In one or more embodiments, the magnetic drum separator 105 (referring to FIG. 1) may include a cartridge that is disposed within the drum 200 (referring to FIG. 2). FIGS. 6A-6E illustrate different views of a fully assembled cartridge 600. The cartridge 600 may be constructed from several subassemblies that will be described in further detail herein. For example, the cartridge 600 may include a cam assembly 605, two end plate assemblies 610, and a plurality of magnet tray assemblies 615. The magnet tray assemblies 615 may include of an array of magnets in the magnetic drum separator 105. The end plate assemblies 610 at opposite ends of the cartridge 600 may attach the array of magnets to a drive assembly (for example, the pulley arrangement 320 with the cable or belt) that rotates the drum 200. As such, the array of magnets may be rotated along with the drum 200. The cam assembly 605 may remain stationary as the drum 200 and array of magnets rotate. The cam assembly 605 may cause the magnets to move radially outward (toward the drum 200) at a certain circumferential location about the rotational axis and may cause the magnets to move radially inward (away from the drum 200) at another circumferential location. Thus, as the magnets rotate with the drum 200, ferrous swarf may be attached to the outside of the drum 200 at certain locations (where the magnets are closer to the drum 200) and the ferrous swarf may later be released from the outside of the drum 200 at another location (where the magnets are no longer close to the drum 200). This way, the magnetic drum separator 105 is able to pick up ferrous swarf on one side (for example, at the inlet 110) of the swarf removal unit 100 (referring to FIG. 1) and deposit the ferrous swarf on another side (for example, at the scraper ramp 115) as the drum 200 rotates. In addition to the components described above, the cartridge 600 may include a number of cartridge support bars 620.

Figure 7:
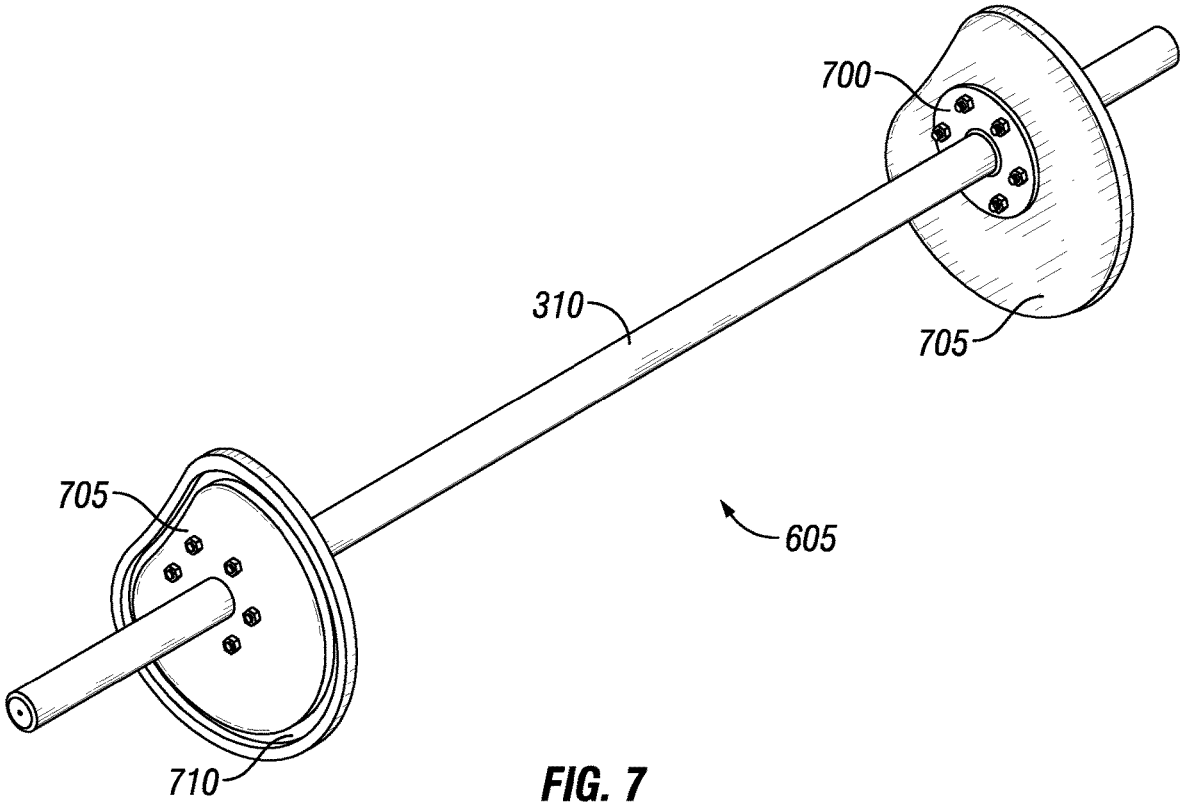
FIG. 7 is an isometric view of a cam assembly, in accordance with an embodiment of the present disclosure.

FIG. 7 illustrates the cam assembly 605, which may include the drum shaft 310, two shaft connection plates 700, and two cam disks 705. The shaft connection plates 700 may couple the cam disks 705 to the drum shaft 310, thereby inhibiting rotation of the cam disks 705 within the magnetic drum separator 105 (referring to FIG. 1). In embodiments, the shaft connection plates 700 may be coupled to the cam disks using any suitable fasteners. Each cam disk 705 may be any suitable size, height, shape, and combinations thereof. In one or more embodiments, each cam disk 705 may have equivalent dimensions. Without limitations, each cam disk 705 may include any suitable material, such as polytetrafluoroethylene, oil-impregnated polyurethane, other such materials exhibiting low coefficient of friction and low wear characteristics, and combinations thereof. Each cam disk 705 may include an irregular (not circular) shape and may include a cam track 710 formed on an outer side of the cam disk 705 for receiving cam followers (described further below) of the magnet tray assemblies 615 (referring to FIGS. 6A-6E). In embodiments, the cam track 710 may be a recessed groove forming a closed loop about the circumference of each cam disk 705 on the outer side of the cam disk 705.

Figure 8A:
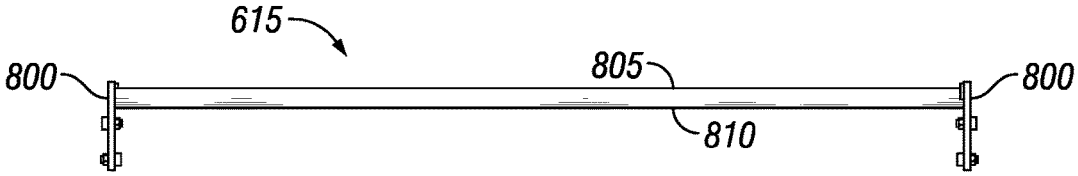
FIGS. 8A-8C are side, bottom, and cross-sectional views of a magnet tray assembly, in accordance with an embodiment of the present disclosure.
Figure 8B:
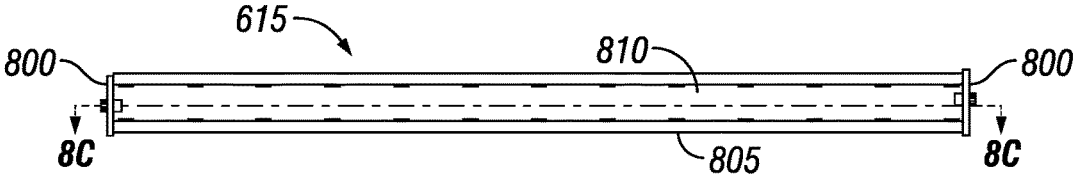
Figure 8C:
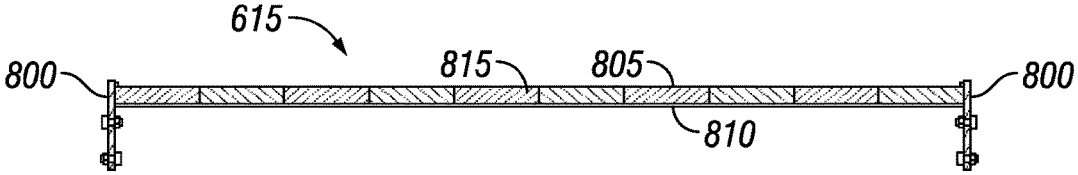

FIGS. 8A-8C illustrate one of the plurality of magnet tray assemblies 615. FIG. 8A illustrates a side view of one of the plurality of magnet tray assemblies 615. FIG. 8B illustrates a bottom view of one of the plurality of magnet tray assemblies 615. FIG. 8C illustrates a cross-section of the side view presented in FIG. 8A of one of the plurality of magnet tray assemblies 615. Each one of the plurality of magnet tray assemblies 615 may be any suitable size, height, shape, and combinations thereof. In one or more embodiments, each one of the plurality of magnet tray assemblies 615 may have equivalent dimensions. The illustrated one magnet tray assembly 615 may include two magnet bracket assemblies 800, a magnet tray 805, and a magnet tray backing plate 810. In one or more embodiments, each magnet bracket assembly 800 may be disposed at an end of the magnet tray 805. The magnet tray backing plate 810 may be disposed below and coupled to a bottom surface of the magnet tray 805, wherein the magnet bracket assemblies are also coupled to the magnet tray backing plate 810. In embodiments, a plurality of magnets 815 may be disposed in the magnet tray 805 and held between the magnet tray 805 and magnet tray backing plate 810. Each of the plurality of magnets 815 may have equivalent dimensions. In other embodiments, each of the plurality of magnets 815 may have different dimensions. Without limitations, each of the plurality of magnets 815 may be secured into the magnet tray assembly 615 using any suitable method including, but not limited to, fasteners, threading, adhesives, welding, and combinations thereof. In one or more embodiments, the magnet bracket assemblies 800 may attach the magnets 815 to the cam assembly 605 and to the end plate assemblies 610.

Figure 9A:
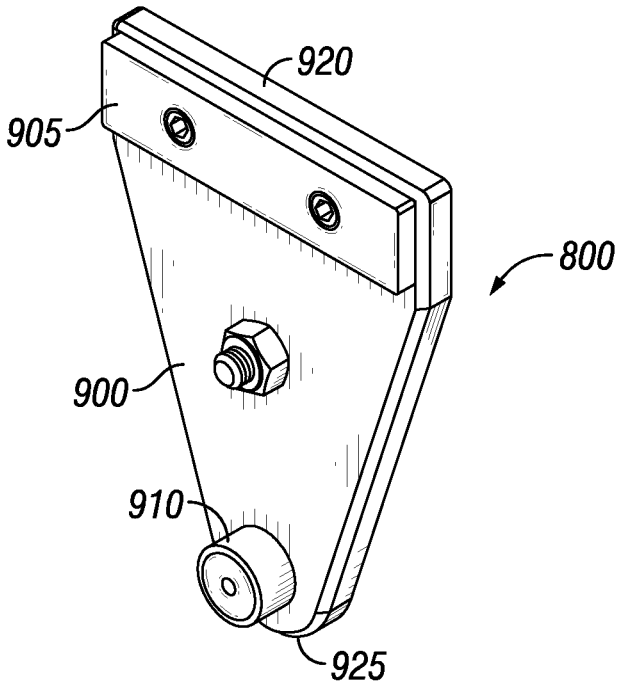
FIGS. 9A-9B are isometric and cross-sectional views of a magnet bracket assembly, in accordance with an embodiment of the present disclosure.
Figure 9B:
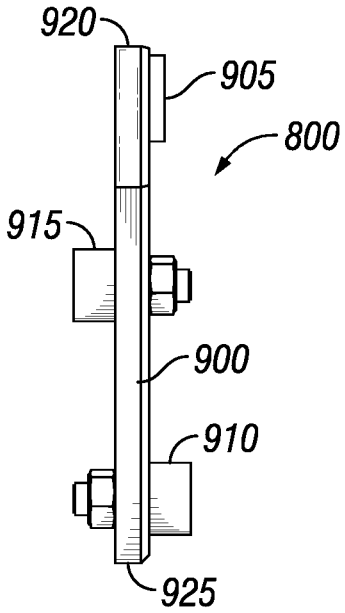

FIGS. 9A-9B illustrate an embodiment of the magnet bracket assembly 800. FIG. 9A illustrates an isometric view of the magnet bracket assembly 800, and FIG. 9B illustrates a side view of the magnet bracket assembly 800. The magnet bracket assembly 800 may include a bracket 900, a bracket plate 905, a cam follower 910 on one side of the bracket 900, and an end plate follower 915 on an opposite side of the bracket 900. In embodiments, the bracket 900 may be any suitable size, height, shape, and combinations thereof. Without limitations, the bracket 900 may generally be triangular in shape, wherein the base of the triangle is a top end 920 of the bracket 900, and wherein a tip of the triangle is a bottom end 925 of the bracket. In embodiments, the bracket plate 905 may be disposed at the top end 920 of the bracket 900. The cam follower 910 may be disposed about the bottom end 925 of the bracket 900. The end plate follower 915 may be disposed in between the cam follower 910 and the bracket plate 905 about any suitable location on the bracket 900. In one or more embodiments, the cam follower 910 and the end plate follower 915 may be fastened to the bracket 900 using any suitable fasteners (for example, a hex nut), wherein the fastener for each of the cam follower 910 and the end plate follower 915 is disposed on opposite sides of the bracket 900. In the fully assembled cartridge 600 (referring to FIGS. 6A-6E), the cam follower 910 may be disposed in the cam track 710 (referring to FIG. 7) of the cam disk 705 (referring to FIG. 7), while the end plate follower 915 may be disposed in a slot of one of the end plate assemblies 610 (referring to FIGS. 6A-6E).

Figures 10A, 10B, 10C:
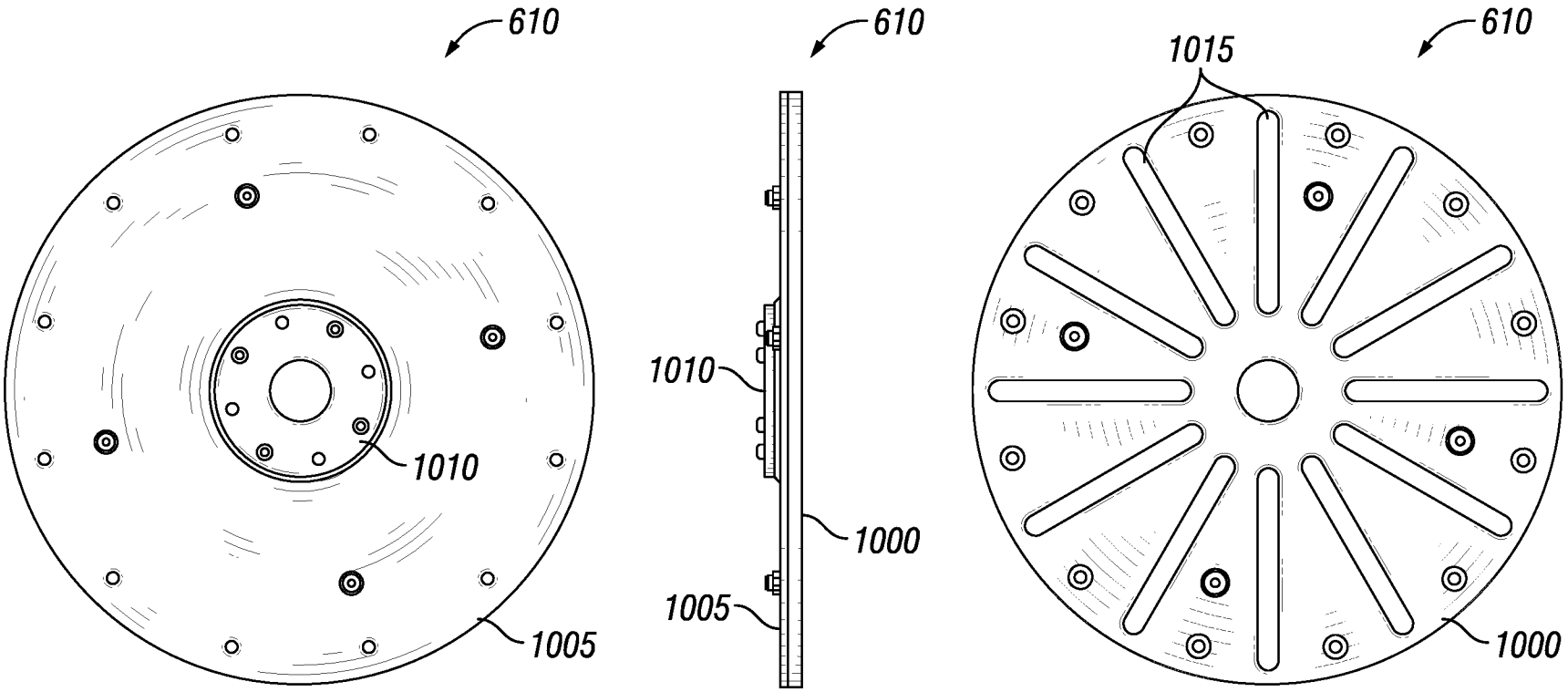
FIGS. 10A-10C are front, side, and back views of a cartridge end plate assembly, in accordance with an embodiment of the present disclosure.

FIGS. 10A-10C illustrate one of the two end plate assemblies 610. In one or more embodiments, the end plate assemblies 610 may rotate with the drum 200 (referring to FIG. 2). The end plate assembly 610 may include a clock plate 1000, a cartridge end plate 1005, and a drive plate assembly 1010. FIG. 10A illustrates an embodiment of the cartridge end plate 1005. FIG. 10B illustrates an embodiment of the clock plate 1000, a cartridge end plate 1005, and the drive plate assembly 1010 coupled together. FIG. 10C illustrates an embodiment of the clock plate 1000. As illustrated, the clock plate 1000 may include radially oriented slots 1015 formed therein, and the radially oriented slots 1015 may be configured to receive the end plate followers 915 (referring to FIG. 9B) of the plurality of magnet bracket assemblies 800 (referring to FIGS. 9A-9B). In one or more embodiments, the slots 1015 may be lined with a sacrificial liner including a suitable plastic to inhibit metal-to-metal contact between the slots 1015 and the end plate followers 915. The slots 1015 may allow the bracket 900 (referring to FIGS. 9A-9B), and therefore the plurality of magnets 815 (referring to FIG. 8C), to move radially inward and outward in response to movement of the plurality of magnet bracket assemblies 800 along the cam track 710 (referring to FIG. 7) of the cam disk 705 (referring to FIG. 7). In one or more embodiments, the cam disk 705 may be disposed in proximity to the clock plate 1000, wherein the plurality of magnet bracket assemblies 800 are disposed between the cam disk 705 and the clock plate 1000 with the end plate followers 915 disposed in the radially oriented slots 1015 and the cam followers 910 (referring to FIGS. 9A-9B) disposed in the cam track 710, thereby coupling to the cam disk 705 and to the clock plate 1000. In embodiments, the cartridge end plate 1005 may be coupled to the clock plate 1000. In these embodiments, the cartridge end plate 1005 may be disposed on an opposite side of the clock plate 1000 as the plurality of magnet bracket assemblies 800, wherein the cartridge end plate 1005 is concentric with the clock plate 1000. The cartridge end plate 1005 may form a longitudinally outer end of the fully assembled cartridge 600 (referring to FIGS. 6A-6E). In one or more embodiments, the drive plate assembly 1010 may be coupled to the cartridge end plate 1005. As illustrated, the drive plate assembly 1010 may be disposed on an opposite side of the cartridge end plate 1005 as the clock plate 1000, wherein the cartridge end plate 1005 is disposed between the drive plate assembly 1010 and the clock plate 1000. In one or more embodiments, the clock plate 1000, the cartridge end plate 1005, and the drive plate assembly 1010 may include a central bore configured to receive the drum shaft 310 (referring to FIG. 3), wherein the drum shaft 310 is disposed through the clock plate 1000, the cartridge end plate 1005, and the drive plate assembly 1010. Further, the clock plate 1000, the cartridge end plate 1005, and the drive plate assembly 1010 may include a plurality of holes suitable for utilizing fasteners in order to couple to each other. The drive plate assembly 1010 may further be coupled to a drive assembly (for example, the pulley arrangement 320 with the cable or belt) of the drum 200 (referring to FIG. 2) to rotate the end plate assemblies 610 along with the drum 200.

Figure 11A:
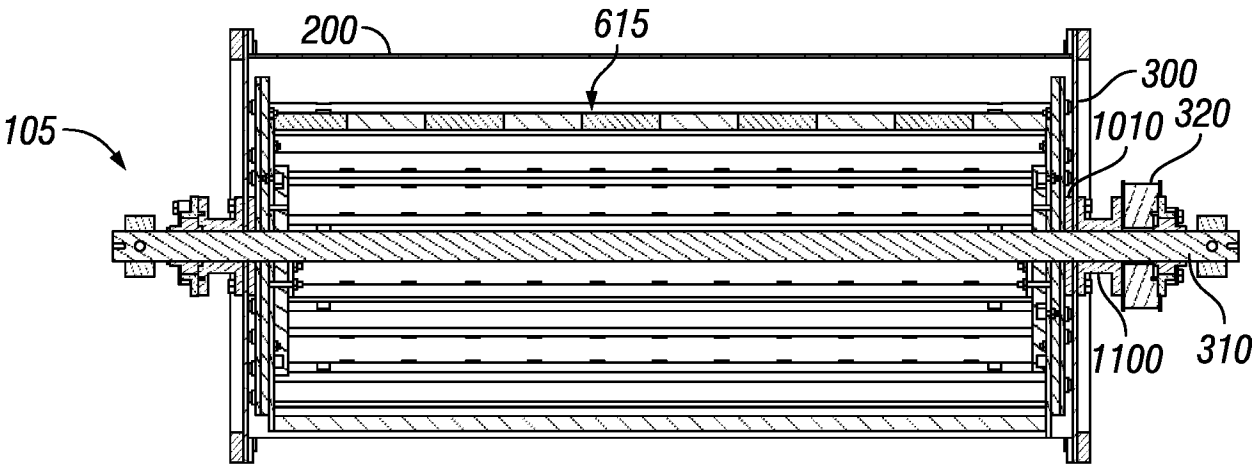
FIGS. 11A-11B are side and cross-sectional views of the magnetic drum separator of FIG. 3, in accordance with an embodiment of the present disclosure.
Figure 11B:
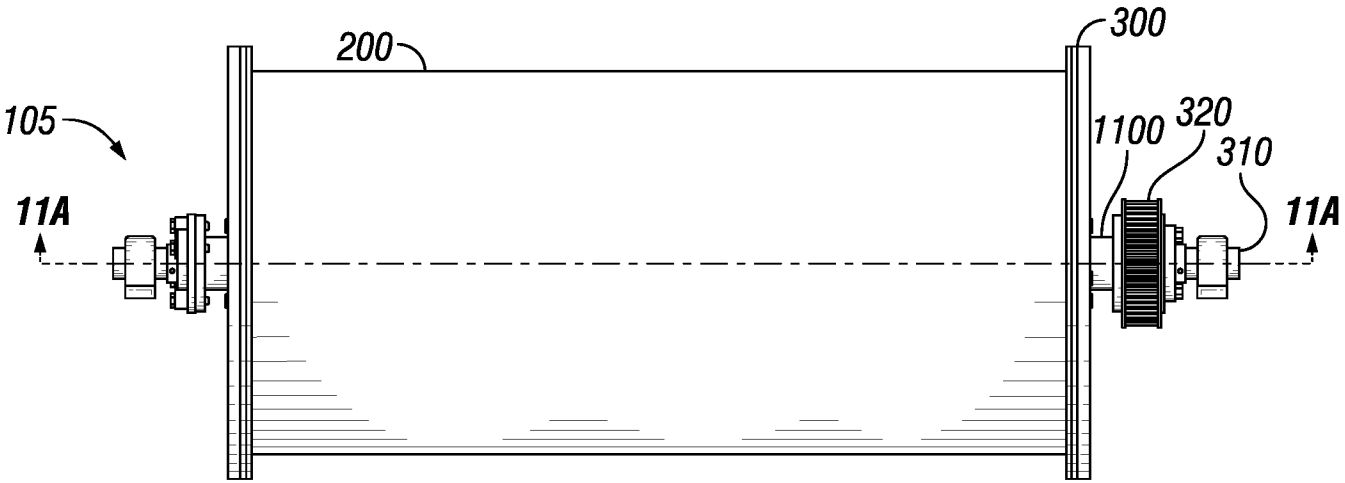

FIGS. 11A-11B illustrate the fully assembled magnetic drum separator 105 and the various components connected together. FIG. 11A illustrates a cross-sectional side view of the magnetic drum separator 105, and FIG. 11B illustrates a side view of the magnetic drum separator 105. As illustrated, a drum hub 1100 may be disposed around the drum shaft 310 between the pulley arrangement 320 and the drum end plate 300. In one or more embodiments, the drum hub 1100 may couple the pulley arrangement 320 to both the drum end plate 300 and the drive plate assembly 1010, as best seen on FIG. 11A. Suitable fasteners may couple one end of the drum hub 1100 to the drum end plate 300 and the drive plate assembly 1010, wherein the drum end plate 300 is disposed between the drum hub 1100 and the drive plate assembly 1010. The pulley arrangement 320 may be coupled to the opposite end of the drum hub 1100.

During operations, the magnetic drum separator 105 may be actuated to remove ferrous swarf from one or more fluids used in a downhole operation. The pulley arrangement 320 and a cable or belt (not shown) may provide rotation to the magnetic drum separator 105. As discussed above, the drum shaft 310 and the cam assembly 605 (referring to FIG. 7) may remain stationary as other components of the magnetic drum separator 105, such as the drum 200, the plurality of magnet tray assemblies 615, and the end plate assemblies 610 (referring to FIGS. 10A-10C) rotate. As the magnetic drum separator 105 operates, the plurality of magnet tray assemblies 615 may translate radially inward or outward while rotating around the central axis 205 (referring to FIG. 2). This may produce localized magnetic fields that are stronger or weaker at designated locations along the circumference of the drum 200. In embodiments, the plurality of magnet tray assemblies 615 may be further away from the central axis 205, therefore closer to the drum 200, about a portion of the magnetic drum separator 105 that is disposed in the flowpath of the one or more fluids provided by the inlet 110 (referring to FIG. 1) of the swarf removal unit 100 (referring to FIG. 1). At this location, there may be a magnetic field strong enough to attract the ferrous swarf present in the one or more fluids. The magnetic field may remove the ferrous swarf from the one or more fluids and displace said ferrous swarf onto the drum 200. As the drum 200 rotates, the cam assembly 605 may displace the plurality of magnet tray assemblies 615 to a radially inward position. Such displacement may weaken the surrounding magnetic field along the outer surface of the drum 200. As such, the ferrous swarf may fall off the drum 200, as the drum 200 is rotating, onto the scraper ramp 115 (referring to FIG. 1) to be collected within the separate containment unit 120 (referring to FIG. 1). In embodiments, the magnetic field from the plurality of magnet tray assemblies 615 may still affect the ferrous swarf while the plurality of magnet tray assemblies 615 are disposed closer to the central axis 205. In these embodiments, the scraper ramp 115 may provide a physical barrier along the rotating drum 200 to physically scrape off the ferrous swarf, wherein the ferrous swarf may then be collected within the separate containment unit 120.

In one or more embodiments, the magnetic drum separator 105 may not include the cam assembly 605. In these embodiments, the end plate followers 915 may be disposed in radially oriented slots (for example, slots 1015 or slots disposed about the drum end plates 300). As the drum 200 rotates, the plurality of magnet tray assemblies 615 may translate radially inward or outward depending on gravity. In one or more embodiments, the clock plate 1000 may include of HARDOX® 450 (available from SSAB Corporation). HARDOX® 450 may be a wear-resistant steel at a nominal hardness of 450 HBW that combines high toughness, good bendability and weldability. HARDOX® 450 may combine good bendability and weldability with an option for guaranteed impact toughness (HARDOX® 450 Tuf). The impact produced from the plurality of magnet tray assemblies 615 translating back and forth along the slots 1015 may ordinarily damage the plurality of magnet tray assemblies 615. As the clock plate 1000 may include HARDOX® 450, the improved material properties may reduce the damage sustained by the plurality of magnet tray assemblies 615 translating.

In one or more embodiments wherein the magnetic drum separator 105 does not include the cam assembly 605, there may be inserts (not shown) disposed in the radially oriented slots. The inserts may be fixed in place and the magnet tray 805 may travel along the length of the radially oriented slots. As the magnet tray 805 translates, the magnet tray 805 may contact the inserts. Such contact may ordinarily damage the magnet tray 805. As there are inserts disposed in the slots, the damage from the forced contact may be reduced as compared to the magnet tray translating into the ends of the slots.

Figure 12:
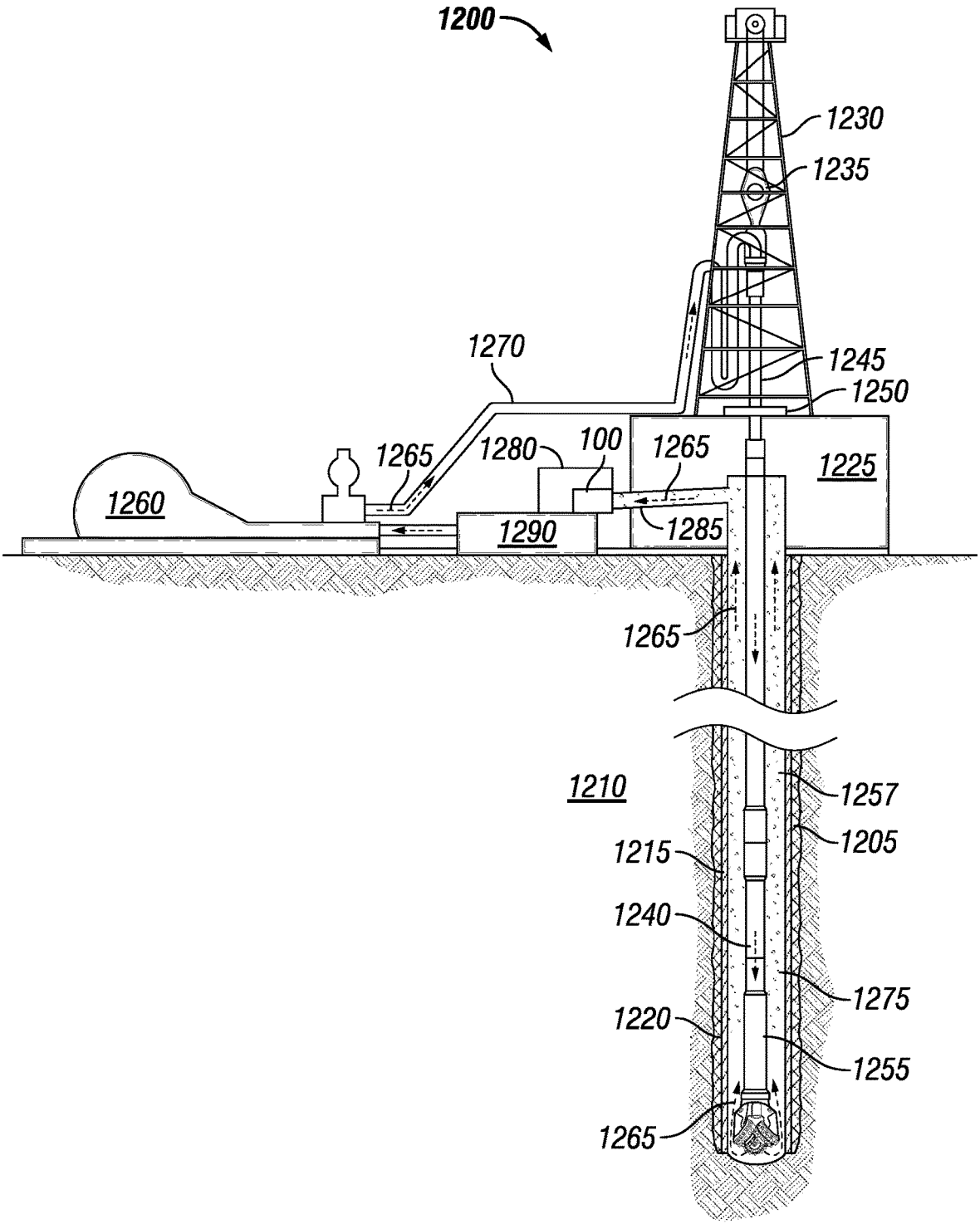
FIG. 12 illustrates a well assembly with a swarf removal unit, in accordance with an embodiment of the present disclosure.

The systems and methods of the present disclosure may directly or indirectly affect one or more components or pieces of equipment associated with the preparation, delivery, recapture, recycling, reuse, and/or disposal of fluids used in the context of various well system operations, including milling operations. For example, the systems and methods may directly or indirectly affect one or more mixers, related mixing equipment, mud pits, storage facilities or units, composition separators, heat exchangers, sensors, gauges, pumps, compressors, and the like used generate, store, monitor, regulate, and/or recondition the fluids from which swarf is removed during milling operations. The systems and methods of the present disclosure may also directly or indirectly affect any transport or delivery equipment used to convey the fluid to a well site or downhole such as, for example, any transport vessels, conduits, pipelines, trucks, tubulars, and/or pipes used to compositionally move fluids from one location to another, any pumps, compressors, or motors (e.g., topside or downhole) used to drive the fluids into motion, any valves or related joints used to regulate the pressure or flow rate of the fluids, and any sensors (i.e., pressure and temperature), gauges, and/or combinations thereof, and the like. For example, and with reference to FIG. 12, the disclosed systems and methods may directly or indirectly affect one or more components or pieces of equipment associated with an example of a well assembly 1200, according to one or more embodiments. It should be noted that while FIG. 12 generally depicts a land-based assembly, those skilled in the art will readily recognize that the principles described herein are equally applicable to subsea operations that employ floating or sea-based platforms and rigs, without departing from the scope of the disclosure. The principles described herein are also equally applicable to milling operations within water well assemblies, without departing from the scope of the disclosure.

As illustrated, a wellbore 1205 has been drilled through various subterranean formations 1210. A casing string 1215 is at least partially cemented within the wellbore 1205 via cement 1220. The term "casing" is used herein to designate a tubular string used to line a wellbore. The casing may actually be of the type known to those skilled in the art as "liner" and may be a segmented liner or a continuous liner, such as coiled tubing.

The well assembly 1200 may include a platform 1225 that supports a derrick 1230 having a traveling block 1235 for raising and lowering a tubular string 1240. In other embodiments, the tubular string 1240 may be run in from a spool. The tubular string 1240 may include, but is not limited to, pipe or coiled tubing, as generally known to those skilled in the art. A kelly 1245 supports the tubular string 1240 as it is lowered through a rotary table 1250. A milling or cutting tool 1255 is attached to the distal end of the tubular string 1240 and is driven either by a downhole motor and/or via rotation of the tubular string 1240 from the well surface. The cutting tool 1255 is rotated to selectively cut and excise one or more portions of the casing string 1215 and cement 1220 over a predetermined section or length of the wellbore 1205. This milling of the casing string 1215 may be performed about an entire circumference and over a particular length of the wellbore 1205 as part of, for example, a decommissioning operation on the well. In other instances, the milling of the casing string 1215 may be performed in a specific direction with respect to an axis of the wellbore 1205, such as during a slot, section, or window milling operation. Regardless of the extent and purpose of the milling operation, cutting the casing string 1215 may generate a large amount of swarf (or ferrous material) 1257 that is circulated back up through an annulus 1275 of the wellbore 1205.

A pump 1260 (e.g., a mud pump) circulates drilling fluid 1265 through a feed pipe 1270 and to the kelly 1245, which conveys the drilling fluid 1265 downhole through the interior of the tubular string 1240 and through one or more orifices in the cutting tool 1255. The fluid 1265 is then circulated back to the surface via the annulus 1275 defined between the tubular string 1240 and the casing string 1215. At the surface, the recirculated or spent fluid 1265 exits the annulus 1275 and may be conveyed to one or more fluid processing unit(s) 1280 via an interconnecting flow line 1285. The fluid processing unit(s) 1280 may include, among other things, one or more swarf removal units 100 used to remove the swarf 1257 from the fluid 1265 returned from the well. After passing through the fluid processing unit(s) 1280, a "cleaned" drilling fluid 1265 is deposited into a nearby retention pit 1290 (i.e., a mud pit). While illustrated as being arranged at the outlet of the wellbore 1205 via the annulus 1275, those skilled in the art will readily appreciate that the fluid processing unit(s) 1280, including swarf removal unit(s) 100 may be arranged at any other location in the well assembly 1200 to facilitate its proper function, without departing from the scope of the disclosure.

As mentioned above, the disclosed systems and methods may directly or indirectly affect the components and equipment of the well assembly 1200 by removing swarf from fluid that might otherwise clog or damage these components. For example, the disclosed systems and methods may directly or indirectly affect the fluid processing unit(s) 1280 which may include, but is not limited to, one or more of a shaker (e.g., shale shaker), a centrifuge, a hydrocyclone, a separator, a desilter, a desander, a filter (e.g., diatomaceous earth filters), a heat exchanger, any fluid reclamation equipment, and the like. The fluid processing unit(s) 1280 may further include one or more sensors, gauges, pumps, compressors, and the like used to store, monitor, regulate, and/or recondition the fluids that are cleaned via the disclosed swarf removal systems and methods.

The disclosed systems and methods may directly or indirectly affect the pump 1260, which representatively includes any conduits, pipelines, trucks, tubulars, and/or pipes used to fluidically convey the cleaned fluids downhole, any pumps, compressors, or motors (e.g., topside or downhole) used to drive the fluids into motion, any valves or related joints used to regulate the pressure or flow rate of the fluids, and any sensors (i.e., pressure, temperature, flow rate, etc.), gauges, and/or combinations thereof, and the like.

The disclosed systems and methods may also directly or indirectly affect the various downhole equipment and tools that may come into contact with the fluids that are cleaned via the swarf removal systems and methods such as, but not limited to, the tubular string 1240, any floats, drill collars, mud motors, downhole motors and/or pumps associated with the tubular string 1240, and any MWD/LWD tools and related telemetry equipment, sensors or distributed sensors associated with the tubular string 1240. The disclosed systems and methods may also directly or indirectly affect any downhole heat exchangers, valves and corresponding actuation devices, tool seals, packers and other wellbore isolation devices or components, and the like associated with the wellbore 1205. The disclosed swarf removal systems and methods may also directly or indirectly affect the cutting tool 1255.

While not specifically illustrated herein, the disclosed swarf removal systems and methods may also directly or indirectly affect any transport or delivery equipment used to convey the cleaned fluids such as, for example, any transport vessels, conduits, pipelines, trucks, tubulars, and/or pipes used to fluidically move the fluids from one location to another, any pumps, compressors, or motors used to drive the fluids into motion, any valves or related joints used to regulate the pressure or flow rate of the fluids, and any sensors (i.e., pressure and temperature), gauges, and/or combinations thereof, and the like.

An embodiment of the present disclosure is a magnetic drum separator, including a drum; a pulley arrangement coupled to the drum, wherein the pulley arrangement imparts rotation onto the drum; a pair of end plate assemblies, wherein one of the pair of end plate assemblies is coupled to the pulley arrangement such that the pulley arrangement rotates the one of the pair of end plate assemblies with the rotation of the drum, wherein each of the pair of end plate assemblies includes a clock plate including radially oriented slots formed therein; a plurality of magnets disposed in the drum, wherein the plurality of magnets is attached to the pair of end plate assemblies and rotatable with the rotation of the drum; and a cam assembly disposed in the drum, wherein the cam assembly remains stationary during the rotation of the drum and the plurality of magnets, wherein the cam assembly includes a cam disk with a cam track formed therein; wherein the cam track and the radially oriented slots guide the plurality of magnets to move in a radially outward direction along a portion of the drum and in a radially inward direction along a remaining portion of the drum as the plurality of magnets rotates.

In one or more embodiments described in the preceding paragraph, the magnetic drum separator further includes a pair of drum end plates, wherein the pair of drum end plates are disposed on opposite ends of the drum, wherein the pair of drum end plates are coupled to the drum through drum flanges. In one or more embodiments described above, the magnetic drum separator further includes one or more wear rings, wherein the one or more wear rings are coupled to the pair of drum end plates, wherein the pair of drum end plates are disposed between the one or more wear rings and the drum flanges. In one or more embodiments described above, the magnetic drum separator further includes a drum hub, wherein the drum hub is disposed in between the pulley arrangement and one of the pair of drum end plates, wherein the drum hub is coupled to both the pulley arrangement and the one of the pair of drum end plates. In one or more embodiments described above, wherein the drum hub is further coupled to the one of the pair of end plate assemblies, wherein the one of the pair of drum end plates is disposed in between the drum hub and the one of the pair of end plate assemblies. In one or more embodiments described above, wherein each of the pair of end plate assemblies includes the clock plate; a cartridge end plate; and a drive plate assembly. In one or more embodiments described above, wherein the cartridge end plate is coupled to the clock plate and the drive plate assembly, wherein the cartridge end plate is disposed in between the clock plate and the drive plate assembly. In one or more embodiments described above, the magnetic drum separator further including a plurality of magnet tray assemblies, wherein each of the plurality of magnet tray assemblies includes: two magnet bracket assemblies; a magnet tray; and a magnet tray backing plate. In one or more embodiments described above, wherein the magnet tray is disposed between and coupled to the two magnet bracket assemblies. In one or more embodiments described above, wherein the magnet tray backing plate is disposed between and coupled to the two magnet bracket assemblies, wherein the magnet tray backing plate is disposed below and coupled to the magnet tray. In one or more embodiments described above, wherein the plurality of magnets is disposed within the magnet tray of each of the plurality of magnet tray assemblies. In one or more embodiments described above, wherein each magnet bracket assembly includes: a bracket; a bracket plate; a cam follower, wherein the cam follower is disposed on one side of the bracket; and an end plate follower, wherein the end plate follower is disposed on an opposite side of the bracket from the cam follower. In one or more embodiments described above, wherein the end plate follower is disposed in one of the radially oriented slots of the clock plate. In one or more embodiments described above, wherein the cam follower is disposed in the cam track of the cam disk. In one or more embodiments described above, the magnetic drum separator further including a drum shaft disposed along a central axis of the magnetic drum separator. In one or more embodiments described above, wherein the cam assembly is coupled to the drum shaft. In one or more embodiments described above, the magnetic drum separator further including at least one shaft support disposed at an end of the drum shaft. In one or more embodiments described above, wherein the cam disk includes of polytetrafluoroethylene, oil-impregnated polyurethane, other such materials exhibiting low coefficient of friction and low wear characteristics, and combinations thereof. In one or more embodiments described above, wherein the drum is configured to remove ferrous swarf from one or more fluids. In one or more embodiments described above, wherein the ferrous swarf includes metallic shavings, filing, particulates, and combinations thereof.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A magnetic drum separator, comprising:

a drum;

a pulley arrangement coupled to the drum, wherein the pulley arrangement imparts rotation onto the drum;

a pair of end plate assemblies, wherein one of the pair of end plate assemblies is coupled to the pulley arrangement such that the pulley arrangement rotates the one of the pair of end plate assemblies with the rotation of the drum, wherein each of the pair of end plate assemblies comprises a clock plate comprising radially oriented slots formed therein;

a plurality of magnets disposed in the drum, wherein the plurality of magnets is attached to the pair of end plate assemblies and rotatable with the rotation of the drum; and a cam assembly disposed in the drum, wherein the cam assembly remains stationary during the rotation of the drum and the plurality of magnets, wherein the cam assembly comprises a pair of cam disks each with a cam track formed therein, wherein each one of the pair of cam disks is disposed in proximity to the clock plate of the pair of end plate assemblies, wherein a plurality of magnet bracket assemblies are disposed between each one of the pair of cam disks and each clock plate with an end plate follower of each magnet bracket assembly being disposed in one of the radially oriented slots and a cam follower of each magnet bracket assembly being disposed in the cam track, thereby coupling each cam disk to each clock plate;

wherein the cam track and the radially oriented slots guide the plurality of magnets to move in a radially outward direction along a portion of the drum and in a radially inward direction along a remaining portion of the drum as the plurality of magnets rotates through the plurality of magnet bracket assemblies.

2. The magnetic drum separator of claim 1, further comprising a pair of drum end plates, wherein the pair of drum end plates are disposed on opposite ends of the drum, wherein the pair of drum end plates are coupled to the drum through drum flanges.

3. The magnetic drum separator of claim 2, further comprising one or more wear rings, wherein the one or more wear rings are coupled to the pair of drum end plates, wherein the pair of drum end plates are disposed between the one or more wear rings and the drum flanges.

4. The magnetic drum separator of claim 2, further comprising a drum hub, wherein the drum hub is disposed in between the pulley arrangement and one of the pair of drum end plates, wherein the drum hub is coupled to both the pulley arrangement and the one of the pair of drum end plates.

5. The magnetic drum separator of claim 4, wherein the drum hub is further coupled to the one of the pair of end plate assemblies, wherein the one of the pair of drum end plates is disposed in between the drum hub and the one of the pair of end plate assemblies.

6. The magnetic drum separator of claim 1, wherein each of the pair of end plate assemblies comprises:

the clock plate;

a cartridge end plate; and a drive plate assembly.

7. The magnetic drum separator of claim 6, wherein the cartridge end plate is coupled to the clock plate and the drive plate assembly, wherein the cartridge end plate is disposed in between the clock plate and the drive plate assembly.

8. The magnetic drum separator of claim 1, further comprising a plurality of magnet tray assemblies, wherein each of the plurality of magnet tray assemblies comprises:

two magnet bracket assemblies;

a magnet tray; and a magnet tray backing plate.

9. The magnetic drum separator of claim 8, wherein the magnet tray is disposed between and coupled to the two magnet bracket assemblies.

10. The magnetic drum separator of claim 8, wherein the magnet tray backing plate is disposed between and coupled to the two magnet bracket assemblies, wherein the magnet tray backing plate is disposed below and coupled to the magnet tray.

11. The magnetic drum separator of claim 8, wherein the plurality of magnets is disposed within the magnet tray of each of the plurality of magnet tray assemblies.

12. The magnetic drum separator of claim 1, wherein each magnet bracket assembly comprises:

a bracket;

a bracket plate;

the cam follower, wherein the cam follower is disposed on one side of the bracket; and the end plate follower, wherein the end plate follower is disposed on an opposite side of the bracket from the cam follower.

13. The magnetic drum separator of claim 1, further comprising a drum shaft disposed along a central axis of the magnetic drum separator.

14. The magnetic drum separator of claim 13, wherein the cam assembly is coupled to the drum shaft.

15. The magnetic drum separator of claim 13, further comprising at least one shaft support disposed at an end of the drum shaft.

16. The magnetic drum separator of claim 1, wherein the each one of the pair of cam disks comprises of polytetrafluoroethylene, oil-impregnated polyurethane, or combinations thereof.

17. The magnetic drum separator of claim 1, wherein the drum is configured to remove ferrous swarf from one or more fluids.

18. The swarf removal unit of claim 17, wherein the ferrous swarf comprises metallic shavings, filing, particulates, and combinations thereof.

* * * * *